US009266366B2

(12) United States Patent
Nagashima et al.

(10) Patent No.: US 9,266,366 B2
(45) Date of Patent: Feb. 23, 2016

(54) PRINTER INCLUDING ROLL SUPPORTING PART AND URGING DEVICE

(71) Applicant: Brother Kogyo Kabushiki Kaisha, Nagoya-shi, Aichi-ken (JP)

(72) Inventors: Yuki Nagashima, Nagoya (JP); Minoru Yamamoto, Nagoya (JP); Takamine Hokazono, Nagoya (JP); Kumiko Uchino, Nagoya (JP); Hidenori Jo, Nagoya (JP); Keiji Seo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/230,406

(22) Filed: Mar. 31, 2014

(65) Prior Publication Data

US 2014/0375738 A1 Dec. 25, 2014

(30) Foreign Application Priority Data

Jun. 24, 2013 (JP) ..... 2013-131862

(51) Int. Cl.
*B41J 2/01* (2006.01)
*B41J 15/04* (2006.01)

(52) U.S. Cl.
CPC ..... *B41J 15/042* (2013.01)

(58) Field of Classification Search
CPC ..... B41J 15/00; B41J 15/04
USPC ..... 347/104
See application file for complete search history.

(56) References Cited

U.S. PATENT DOCUMENTS

| | | | | |
|---|---|---|---|---|
| 6,241,407 | B1 * | 6/2001 | Huggins et al. | 400/611 |
| 6,810,802 | B2 * | 11/2004 | Huang | 101/328 |
| 7,809,654 | B2 * | 10/2010 | Blanluet et al. | 705/401 |
| 7,917,453 | B2 * | 3/2011 | Auberger et al. | 705/401 |
| 2005/0232677 | A1 | 10/2005 | Ogawa et al. | |
| 2006/0092193 | A1 * | 5/2006 | Block et al. | 347/2 |
| 2007/0237563 | A1 * | 10/2007 | Maekawa | 400/611 |
| 2012/0026265 | A1 | 2/2012 | Kawashima | |

FOREIGN PATENT DOCUMENTS

| | | |
|---|---|---|
| JP | H05177828 | 7/1993 |
| JP | H0776443 | 3/1995 |
| JP | 2006-159413 A | 6/2006 |
| JP | 2010036379 | 2/2010 |
| JP | 2011073241 A * | 4/2011 |

OTHER PUBLICATIONS

Oct. 21, 2014—(EP) Extended Search Report—App14162651.5.

* cited by examiner

*Primary Examiner* — Julian Huffman
*Assistant Examiner* — Sharon A Polk
(74) *Attorney, Agent, or Firm* — Banner & Witcoff, Ltd.

(57) ABSTRACT

A printer including a roll supporting part, a feed roller, a printing head, and an urging device. The roll supporting part rotatably supports a print-receiving tape roll including a print-receiving tape in a rolled shape. The feed roller pulls out and feeds the print-receiving tape and the printing head prints on the print-receiving tape. The urging device slides to and contacts an outer peripheral surface of the print-receiving tape in the rolled shape and elastically presses the print-receiving tape roll supported by the roll supporting part while the print-receiving tape is fed.

5 Claims, 11 Drawing Sheets

PRINTER INCLUDING ROLL SUPPORTING PART AND URGING DEVICE

CROSS-REFERENCE TO RELATED APPLICATION

The present application claims priority from Japanese Patent Application No. 2013-131862, which was filed on Jun. 24, 2013, the disclosure of which is incorporated herein by reference in its entirety.

BACKGROUND

1. Field

The present disclosure relates to a printer that forms desired print on a print-receiving tape.

2. Description of the Related Art

There has been known a printer that forms print on a print-receiving tape. In this prior art printer, a print-receiving tape roll is loaded and used. The above described print-receiving tape (tag tape) is wound around the print-receiving tape roll in a rolled form, and desired print is formed on the print-receiving tape that is pulled out from the print-receiving tape roll and is fed. At this time, in this prior art, the print-receiving tape roll is wound around a substantially cylindrical winding core, and cuts for suppressing the above described print-receiving tape from coming apart are disposed on a tape holder that rotatably supports the winding core.

In the printer as described above, during printing operation, the print-receiving tape roll rotates by pull-out of the above described print-receiving tape. When printing operation stops, rotation of the print-receiving tape roll also stops due to the halt of pull-out. When execution and stop of the printing operation are repeated, rotation and stop of the print-receiving tape roll are also reiterated. At this time, slack occurs in the print-receiving tape due to rotation by inertia of the print-receiving tape roll. As a result, in the print-receiving tape roll, the above described print-receiving tape wound in the rolled form may come apart in a radial direction. In a case where such coming-apart is generated, meandering of the print-receiving tape occurs at the time of subsequent feeding after the start of printing operation, and there is a possibility of causing irregularity in print positions and deterioration of print quality.

In the above described prior art, although it is considered to suppress coming-apart of the print-receiving tape at the time of non-operation when the printing operation as described above is not performed and at the time of attachment and detachment of the tape holder, it has not been considered to achieve coming-apart suppression of the print-receiving tape at the time of the printing operation as described above.

SUMMARY

An object of the present disclosure is to provide a printer that can achieve coming-apart suppression of a print-receiving tape at the time of printing operation.

In order to achieve the above-described object, according to the aspect of the present application, there is provided a printer comprising a roll supporting part configured to rotatably support a print-receiving tape roll that winds a print-receiving tape in a rolled form, a feeder configured to pull out and feed said print-receiving tape of said print-receiving tape roll supported by said roll supporting part, a printing head configured to perform desired print on said print-receiving tape that is fed out and fed from said print-receiving tape roll by said pull-out of said feeder, and an urging device configured to elastically press the print-receiving tape roll supported by said roll supporting part inward in a radial direction of said print-receiving tape roll while said print-receiving tape being fed out.

In a printer of the disclosure in the present application, the print-receiving tape roll is loaded and used. The print-receiving tape is wound around the print-receiving tape roll in the rolled form, and the print-receiving tape is pulled out and fed by the feeder. Desired print is formed on the fed print-receiving tape by the printing head.

At this time, the print-receiving tape roll is rotatably supported by the roll supporting part. During the printing operation as described above, the print-receiving tape roll rotates due to the pull-out of the print-receiving tape by the above described feeder in a state of being supported by the roll supporting part. When printing operation stops, rotation of the above described print-receiving tape roll also stops due to the halt of the pull-out by the above described feeder. When execution and stop of the printing operation are repeated, rotation and stop of the print-receiving tape roll are also reiterated. As a result, in the print-receiving tape roll, the above described print-receiving tape wound in the rolled form may come apart in the radial direction. In the case where such coming-apart is generated, meandering of the print-receiving tape occurs at the time of subsequent feeding, and there is a possibility of causing irregularity in print positions and deterioration of print quality.

Consequently, the urging device is disposed in the disclosure in the present application. This urging device elastically presses inward in the radial direction the print-receiving tape roll rotatably supported by the roll supporting part (in a state where the print-receiving tape has been fed out as described above). Consequently, the print-receiving tape can be suppressed from coming apart in the radial direction as described above. As a result, the above described irregularity in print positions and deterioration of print quality can be suppressed.

DETAILED DESCRIPTION OF THE PREFERRED EMBODIMENTS

Hereinafter, one embodiment of the present disclosure will be explained with reference to drawings.

<Appearance Schematic Configuration>

First, using FIG. 1, will be explained an appearance schematic configuration of a label producing apparatus 1 of the present embodiment. It is to be noted that in the following explanation, a front and rear direction, a right and left direction, and an up and down direction represent directions of arrows appropriately shown in each drawing, such as FIG. 1.

Figure 1:
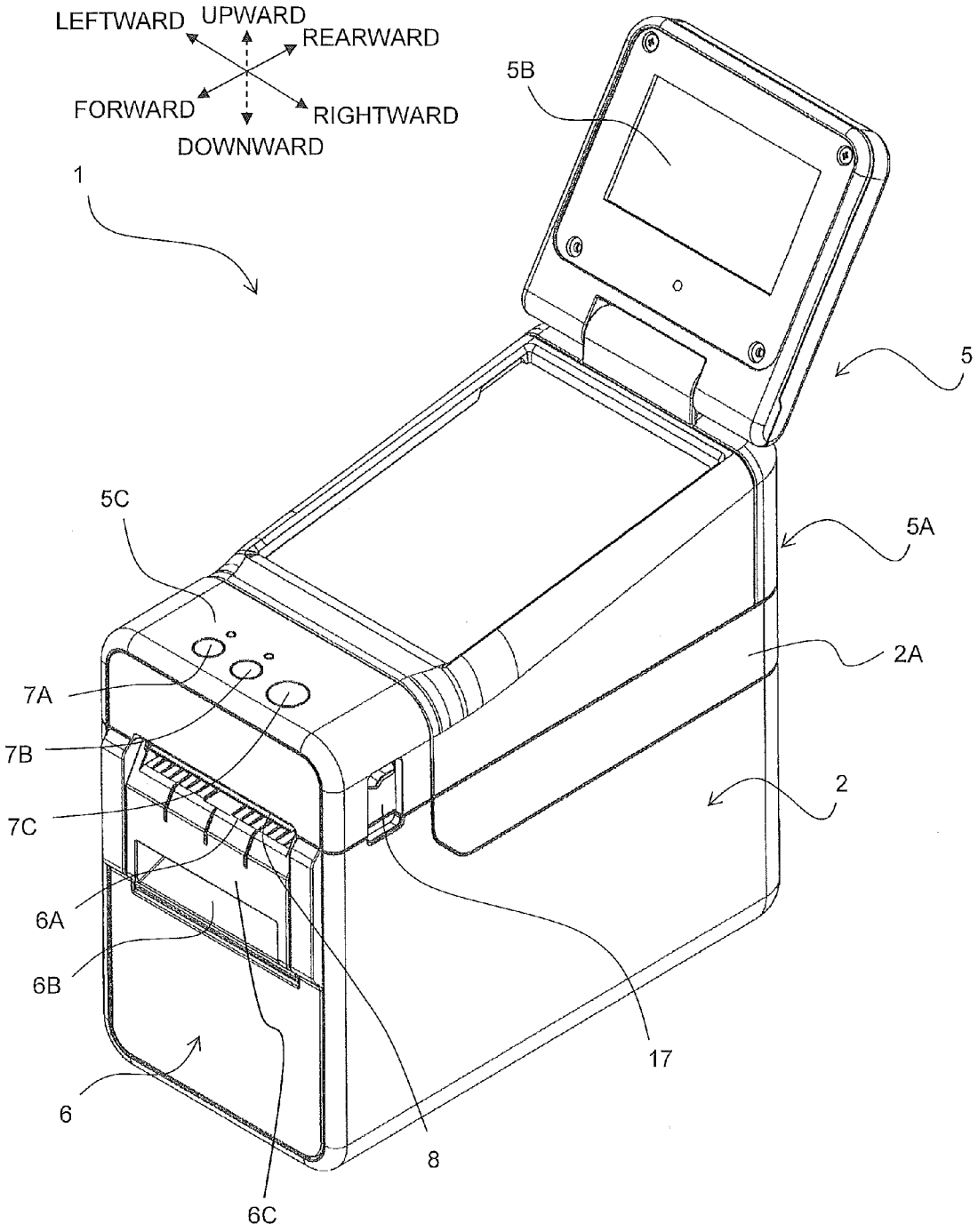
FIG. 1 is a perspective view showing an appearance of a label producing apparatus of one embodiment of the present disclosure.

In FIG. 1, the label producing apparatus 1 has: a housing 2 including a front panel 6; and an upper cover unit 5. These housing 2 and upper cover unit 5 are, for example, made of resin. The upper cover unit 5 has: a touch panel part 5A; a substantially rectangular liquid crystal panel part 5B; and an operation button part 5C.

The upper cover unit 5 is turnably connected to the housing 2 through a rotation shaft part 2*a* (refer to after-mentioned FIG. 4) in a rearward end, and thereby the upper cover unit 5 has a structure openable and closable with respect to the housing 2. It is to be noted that a housing cover part 2A included in a part of the above described housing 2 is configured integrally with a lower portion of the upper cover unit 5, and that the housing cover part 2A is also opened and closed in an integral manner (refer to after-mentioned FIGS. 2, 3, etc.) at the time of opening and closing of the upper cover unit 5.

The liquid crystal panel part 5B is turnably connected to the touch panel part 5A through a rotation shaft part 5*a* (refer to after-mentioned FIG. 4) in the rearward end, and thereby the liquid crystal panel part 5B has a structure openable and closable with respect to the touch panel part 5A.

The operation button part 5C is disposed on an upper surface position closer to a front of the upper cover unit 5, and a power button 7A of the label producing apparatus 1, a status button 7B for displaying a peripheral device actuation state, a feed button 7C, etc. are arranged at the operation button part 5C.

A release knob 17 is disposed on both right and left side walls of the housing 2. This release knob 17 is upwardly pushed up, thereby locking of the upper cover unit 5 to the housing 2 is released, and the upper cover unit 5 becomes an openable state.

On the front panel 6, disposed are: a first discharging exit 6A; and a second discharging exit 6B located at a portion of a lower side than the first discharging exit 6A. In addition, a portion of the front panel 6 that has the second discharging exit 6B serves as a rotatable openable and closable lid 6C that can be turned to a forward side in order to suit the convenience of installation of an after-mentioned print-receiving tape 3A and paper discharge, for example.

When the upper cover unit 5 is set as a closed state, the first discharging exit 6A is formed of an upper edge of a front surface side of the housing 2, and a lower edge of a front surface side of the above described upper cover unit 5. It is to be noted that a cutting blade 8 is disposed directed downwardly on an inside of the lower edge in the first discharging exit 6A side of the upper cover unit 5 (refer to FIGS. 2, 3, etc., which will be described later).

<Internal Structure>

Subsequently, an internal structure of the label producing apparatus 1 of the present embodiment will be explained using FIGS. 2 to 5.

Figure 2:
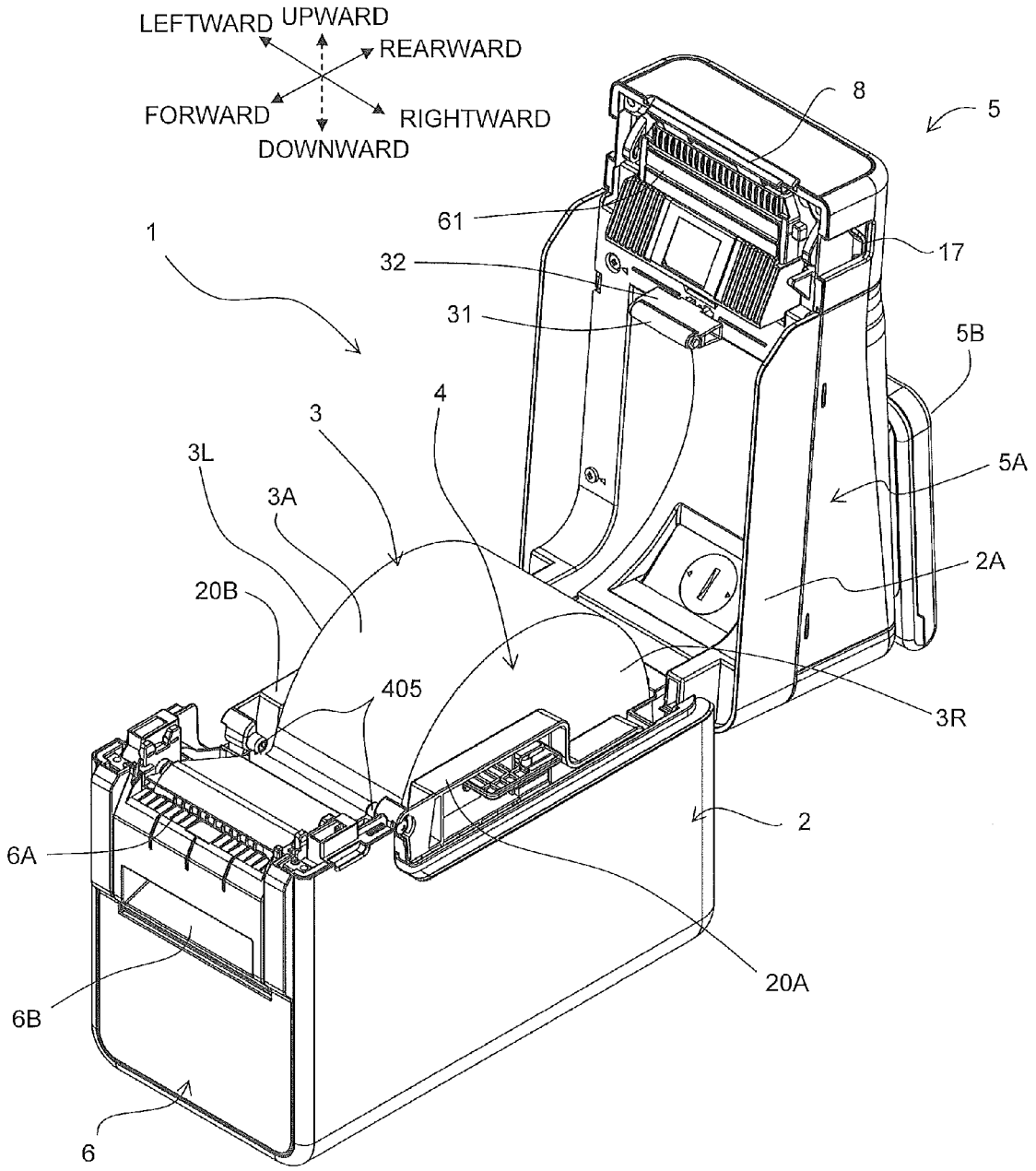
FIG. 2 is a perspective view representing a state where an upper cover unit is opened and a roll is loaded in the label producing apparatus.
Figure 3:
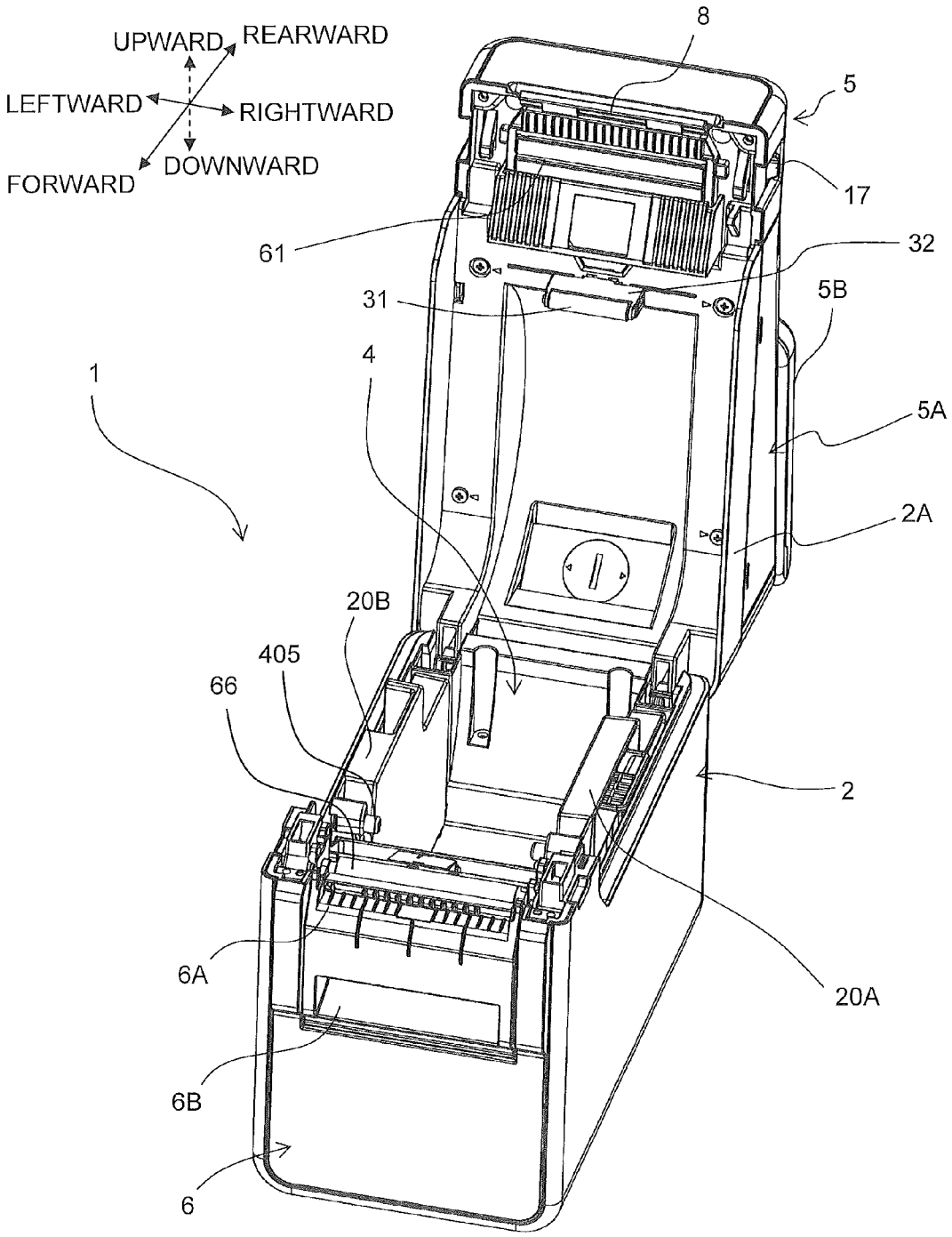
FIG. 3 is a perspective view representing a state where the upper cover unit is opened and the roll is removed in the label producing apparatus.

As shown in FIGS. 2 and 3, the label producing apparatus 1 has a concave roll containing part 4 at a rear of an internal space of the housing 2. The roll containing part 4 contains a roll 3 around which the print-receiving tape 3A with a desired width has been wound in a rolled form so that the print-receiving tape 3A is fed out from an upper side of the roll in this example. The roll 3 is rotatably contained in the roll containing part 4 in a state where an axis line of winding of the above described print-receiving tape 3A corresponds to a right and left direction perpendicular to a front-back direction.

<Print-Receiving Tape>

Figure 4:
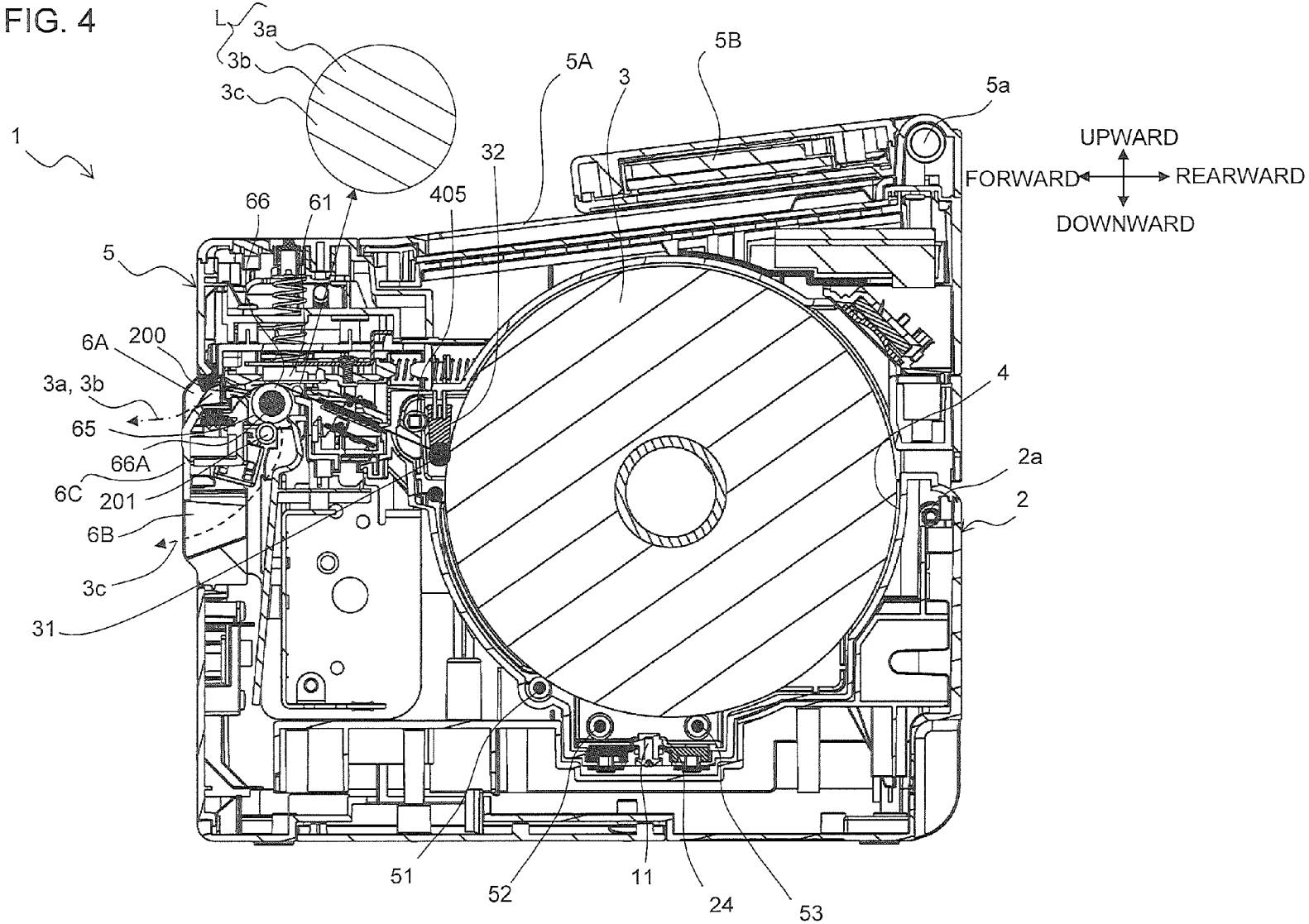
FIG. 4 is a side sectional view representing an entire structure of the label producing apparatus.

In the print-receiving tape 3A included in the roll 3, as shown in an enlarged view in FIG. 4, a label mount L is continuously arranged on a separation material layer 3*c* along a longitudinal direction. Namely, the label mount L has a two-layer structure in this example, and a print-receiving layer 3*a* on which desired print is formed by a print head 61, and an adhesive layer 3*b* are stacked in that order. Additionally, the label mount L is bonded on a one side surface of the separation material layer 3*c* at a predetermined interval by means of adhesive power of the above described adhesive layer 3*b*. Namely, the print-receiving tape 3A has a three-layer structure (refer to the enlarged view in FIG. 4) of the print-receiving layer 3*a*, the adhesive layer 3*b*, and the separation material layer 3*c* in a portion to which the label mount L has been bonded, and has a one-layer structure of only the separation material layer 3*c* in a portion to which the label mount L has not been bonded (i.e., the portion between the label mounts L). The label mount L in which printing is completed is eventually pasted on an adherend as a print label by being peeled from the separation material layer 3*c*. It is to be noted that in FIG. 4, illustration of an after-mentioned spring 400 is omitted for preventing complication of illustration.

<Support Roller>

Three support rollers 51 to 53 are disposed on a bottom surface of the roll containing part 4. In the support rollers 51 to 53, at least two rollers get contact with an outer peripheral surface of the roll 3, thereby drivenly rotate, and rotatably support the roll 3 in a range from a minimum diameter (a state where the print-receiving tape 3A has been consumed most) to a maximum diameter (a state where the print-receiving tape 3A has not been consumed) of the roll 3, in a platen roller 66 being rotationally driven and the print-receiving tape 3A being pulled out from the upper side of the roll 3. Positions of these three support rollers in a peripheral direction with respect to the roll 3 respectively differ, and a first support roller 51, a second support roller 52, and a third support roller 53 are arranged in that order along a peripheral direction of the roll 3 from a front (in other words, a pull-out direction, a left side in FIG. 4) toward a rear (in other words, an opposite direction of the pull-out direction, a right side in FIG. 4). These first to third support rollers 51 to 53 are divided into a plurality of portions in the above described right and left direction (in other words, a roll width direction), and only the portion in which the roll 3 has been mounted rotates according to a roll width. In addition, the second support roller 52 and the third support roller 53 have a positional relation of substantially horizontal to each other, and the first support roller 51 is arranged so as to be located at a higher position than the second support roller 52 and the third support roller 53.

<Guide Member>

Meanwhile, on the roll containing part 4, also disposed are: a first guide member 20A that gets contact with an end surface 3R (refer to FIG. 2) of a right side of the roll 3 to guide the print-receiving tape 3A to the right and left direction (i.e., the tape width direction, the same hereinafter); and a second guide member 20B that gets contact with an end surface 3L (refer to FIG. 2) of a left side of the roll 3 to guide the print-receiving tape 3A to the right and left direction. These first guide member 20A and second guide member 20B are mutually approachable by advancing and retreating along the above described right and left direction. The first guide member 20A then gets contact with the roll 3 from the right side and also, the second guide member 20B gets contact with the roll 3 from the left side, and thereby they guide the print-receiving tape 3A while sandwiching the roll 3 from both sides. As described above, since both the guide members 20A and 20B are disposed advanceable and retreatable along the right and left direction, the both guide members 20A and 20B are advanced and retreated according to the width of the contained roll 3 to adjust a position of the roll 3, thereby the roll 3 with an arbitrary width is sandwiched by the both guide members 20A and 20B, and the width direction of the print-receiving tape 3A can be guided. It is to be noted that will be described later details of a support structure for advancing and retreating these guide members 20A and 20B.

<Platen Roller, Print Head, and Peripheral Structure>

Meanwhile, as shown in FIG. 4, the above described print head 61 is disposed on a lower side of a front end of the upper cover unit 5. In addition, the above described platen roller 66 is disposed on an upper side of a front end of the housing 2 so as to face the print head 61 in the up and down direction. A roller shaft 66A of the platen roller 66 is rotatably supported by a bracket 65 (refer to FIG. 4) disposed on both ends in an axis direction and also, a gear (not shown) that drives the platen roller 66 is fixed to one shaft end of the roller shaft 66A.

At this time, an arrangement position of the platen roller 66 in the housing 2 corresponds to an attachment position of the print head 61 in the upper cover unit 5. Additionally, the upper cover unit 5 is closed, thereby the print-receiving tape 3A is sandwiched by the print head 61 disposed on an upper cover unit 5 side, and the platen roller 66 disposed on a housing 2 side, and the label producing apparatus 1 becomes a state where printing by the print head 61 can be performed. In addition, the upper cover unit 5 is closed, thereby the above described gear fixed to the roller shaft 66A of the platen roller 66 meshes with a gear train, which is not shown, of the housing 2 side, and the platen roller 66 is rotationally driven, for example, by a platen roller motor (not shown) including a stepping motor etc. Consequently, the platen roller 66 feeds out the print-receiving tape 3A from the upper side in this example of the roll 3 contained in the roll containing part 4 (however, may feed it out from a lower side), and feeds the print-receiving tape 3A with a posture in which the tape width direction of the print-receiving tape 3A is set as the right and left direction.

Although not particularly shown, an intermediate portion of the print head 61 is pivotally supported and also, the print head 61 is installed downwardly urged by a suitable spring member. The upper cover unit 5 is set as an opened state by the above described release knob 17, and thereby the print head 61 becomes a state of being spaced apart from the platen roller 66 (refer to FIG. 3 etc.). Meanwhile, the upper cover unit 5 is closed, thereby the print head 61 presses and urges the print-receiving tape 3A to the platen roller 66 by an urging force of the spring member, and becomes a state where printing can be performed.

It is to be noted that the print-receiving tape 3A is configured by the above described roll 3 being wound therearound in the rolled form so that the above described label mount L is located at an outside in the radial direction (however, when the print-receiving tape 3A is fed out from the lower side of the roll 3 as described above, the above described label mount L is located at an inside in the radial direction). As a result, the print-receiving tape 3A is fed out from the upper side of the roll 3 in a state where a surface of a label mount L side is set as an upward side, and print is formed on the print-receiving tape 3A by the print head 61 arranged at an upper side of the print-receiving tape 3A.

In addition, on a forward side closer than the platen roller 66, disposed is a release plate 200 to peel off the above described print-receiving layer 3*a* and adhesive layer 3*b* from the separation material layer 3*c* by folding the separation material layer 3*c* to a downward side of the platen roller 66. The printed print-receiving layer 3*a* and adhesive layer 3*b* that have been peeled off from the separation material layer 3*c* by the above described release plate 200 are discharged to an outside of the housing 2 through the above described first discharging exit 6A located at a further forward side of the release plate 200 (refer to an alternate long and short dash line in FIG. 4). The cutting blade 8 is used for an operator cutting at a desired position the print-receiving layer 3*a* and the adhesive layer 3*b* that are discharged to the outside of the housing 2 through the above described first discharging exit 6A.

Meanwhile, on a lower part of the platen roller 66, disposed is a pinch roller 201 that feeds the separation material layer 3*c* folded to the downward side by the above described release plate 200 while pinching it between the platen roller 66 and itself. The above described separation material layer 3*c* fed by the above described pinch roller 201 is discharged to the outside of the housing 2 from the above described second discharging exit 6B (refer to a broken line in FIG. 4). It is to be noted that the pinch roller 201 is disposed on the above described openable and closable lid 6C through a suitable support part (not shown).

In addition, a pressing roller 31 is disposed near a feeding-out position of the print-receiving tape 3A in the roll 3 contained in the roll containing part 4, the position being closer to a rearward side than the platen roller 66. This pressing roller 31 is rotatably supported at a tip end of a support member 32 downwardly extended from the upper cover unit 5 toward a vicinity of the above described feeding-out position. The upper cover unit 5 is set as the opened state by the release knob 17, and thereby the support member 32 and the pressing roller 31 also become a state of being spaced apart from the roll containing part 4 (refer to FIGS. 2, 3, 5, etc.).

<Details of Support Structure of Advancing and Retreating of Guide Member>

Subsequently, using FIG. 6 and the above described FIG. 5, will be explained details of a support structure of advancing and retreating of both guide members 20A and 20B using the above described first to third support rollers 51, 52, and 53.

<Rail Member and Guide Fitting Part>

Figure 5:
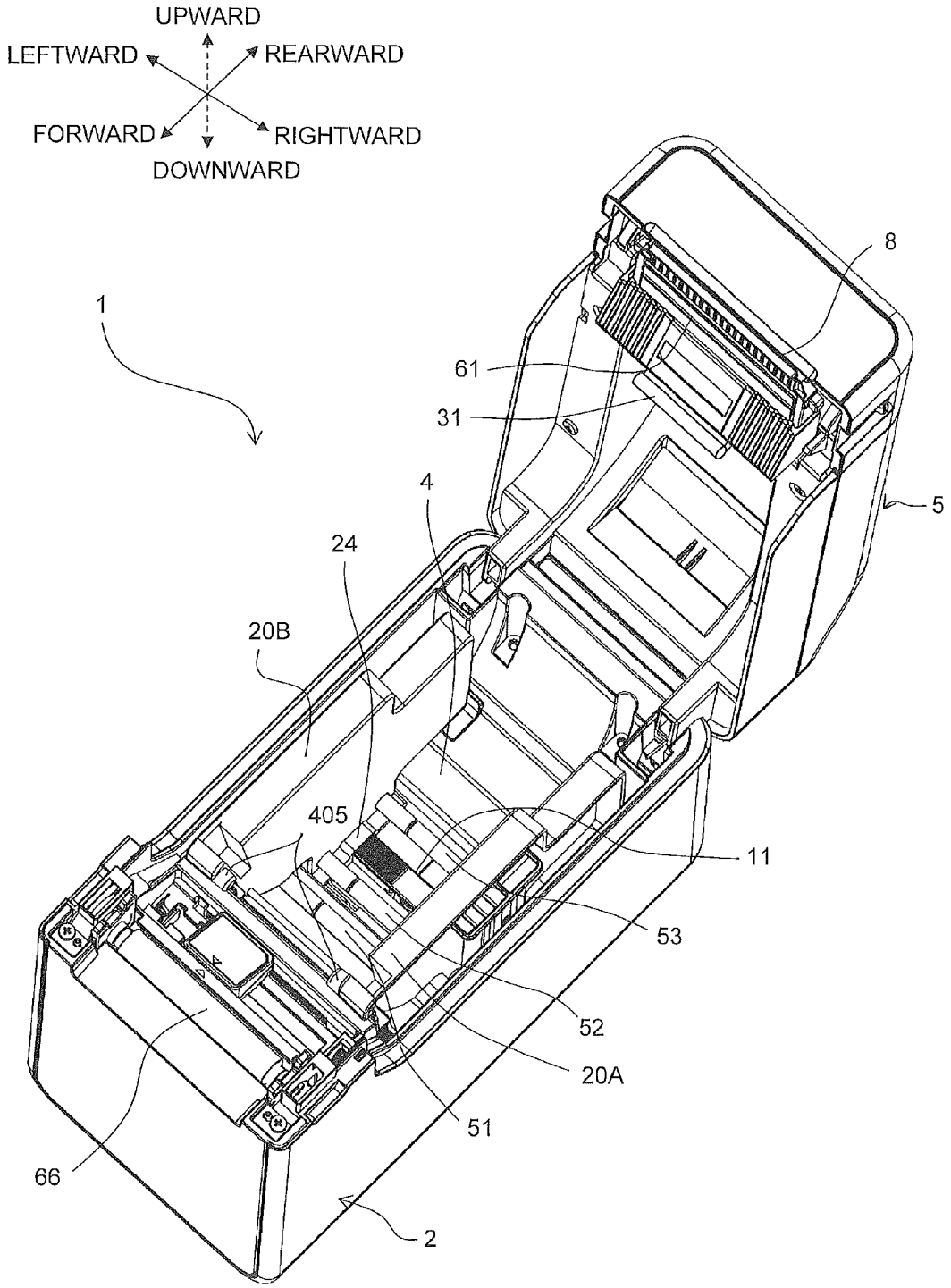
FIG. 5 is a perspective view representing the state where the upper cover unit is opened and the roll is removed in the label producing apparatus.

As shown in the above described FIG. 5, rail members 11 are disposed on the bottom surface of the roll containing part 4. Meanwhile, corresponding to this, the guide members 20A and 20B have concave guide fitting parts 24 in centers of lower ends thereof. Additionally, the above described rail members 11 are fitted in the above described guide fitting parts 24 of the guide members 20A and 20B along the width direction (i.e., the above described right and left direction) of the roll 3, guide the guide members 20A and 20B while allowing advancing and retreating thereof, and hold positions of the guide members 20A and 20B in an advancing and retreating direction. It is to be noted that although only a detailed structure of the guide member 20B is shown in FIG. 5, the guide member 20A also has a substantially equal structure (except that right and left are reversed).

Figure 6:
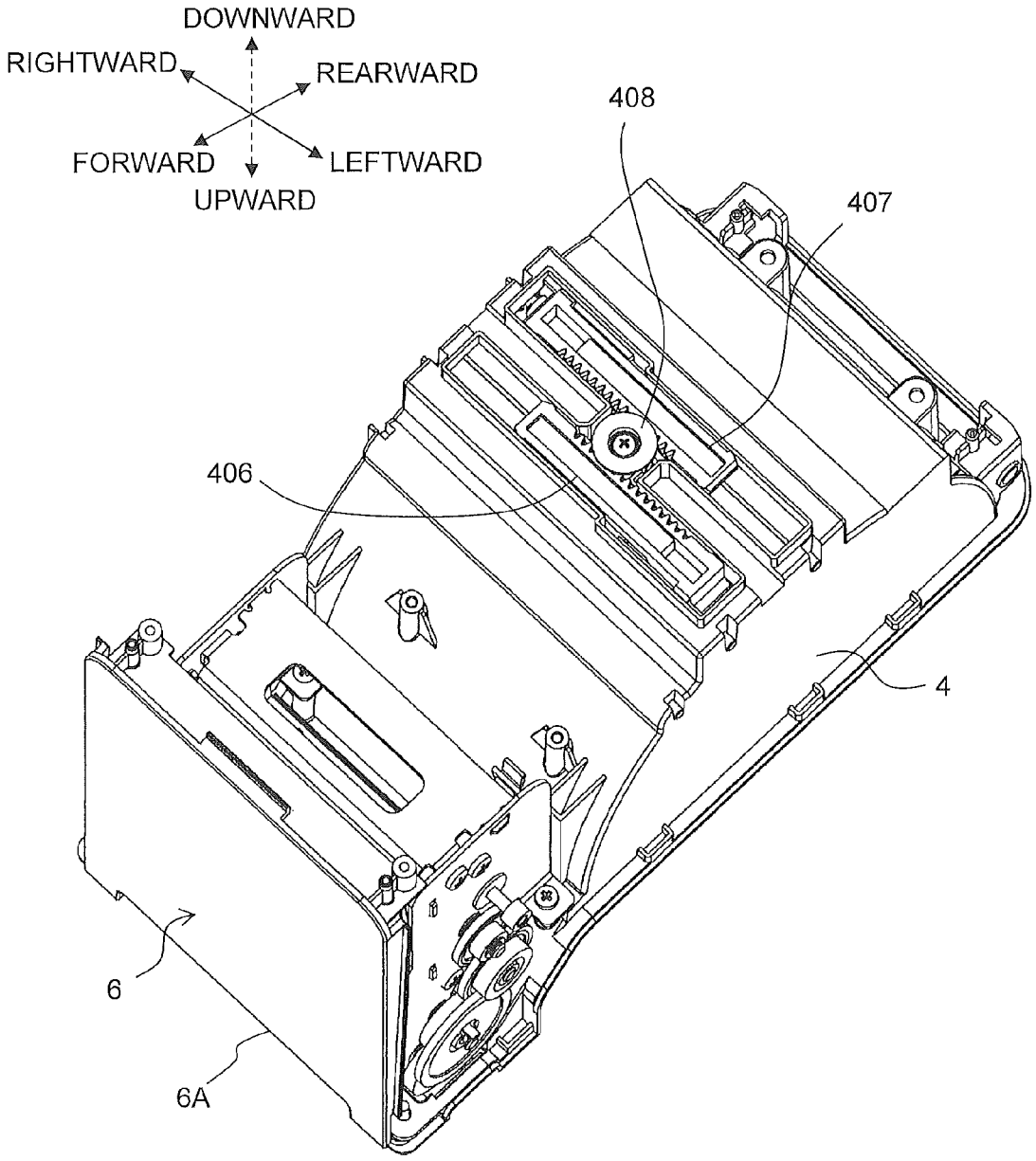
FIG. 6 is a perspective view in a state where a roll containing part on which a guide member is disposed is seen from a lower surface side.

At this time, on the guide members 20A and 20B, rack members 406 and 407 as shown in FIG. 6 are projectingly disposed on each one side with respect to the guide fitting parts 24 in a horizontal direction. These rack members 406 and 407 are disposed so as to alternately face with respect to each of the guide fitting parts 24 of the guide members 20A and 20B. Additionally, as shown in FIG. 6, both rack members 406 and 407 have meshed with a central gear 408 from both sides in a lower surface side of the roll containing part 4. As a result, only one of the guide members 20A and 20B (the guide member 20A in this example) is moved to one side along the rail 11, and interlockingly with the movement, the other (the guide member 20B in this example) moves in the other direction along the rail through the gear 408.

In the above manner, the pair of guide members 20A and 20B is disposed mutually approachable by interlockingly advancing and retreating in the width direction (right and left direction) of the roll 3 with respect to a reference position (a center position in the right and left direction), and defines a position in the width direction of the print-receiving tape 3A fed out from the roll 3 while pinching the contained roll 3.

In addition, on each of the guide members 20A and 20B, guide projecting parts 405 are disposed projecting inwardly so as to mutually face along the above described right and left direction. The guide projecting parts 405 get contact with an end of the width direction of the print-receiving tape 3A that is fed out from the roll 3 from an upward side, and guide it. Consequently, flapping of the print-receiving tape 3A in the up and down direction can be pressed at both ends of the print-receiving tape 3A fed out from the roll 3 that rotates within the roll containing part 4.

<Basic Operation of Feeding and Printing>

In the above described basic configuration, when the upper cover unit 5 is closed, and the platen roller 66 is rotated and driven by the above described platen roller motor, the print-receiving tape 3A is pulled. Consequently, the print-receiving tape 3A is fed out from the roll 3 with being contacted from an upward side by the above described pressing roller 31, while the width direction of the print-receiving tape 3A being guided by the guide members 20A and 20B. Desired print is formed by the print head 61 on the print-receiving tape 3A fed out from the roll 3 and subsequently, the print-receiving tape 3A is folded to the downward side of the platen roller 66 by the release plate 200. At this time, utilizing that the firm print-receiving layer 3*a* cannot follow such a folded path, the print-receiving layer 3*a* and the adhesive layer 3*b* are peeled off from the separation material layer 3*c* as described above. The print-receiving layer 3*a* and the adhesive layer 3*b* (in other words, the label mount L) that have been peeled off by the release plate 200 as described above are discharged to the outside of the housing 2 from the first discharging exit 6A, and are used as print labels. It is to be noted that in FIG. 4, as described above, a feeding path of the print-receiving layer 3*a* and the adhesive layer 3*b* that have been peeled off is shown by the alternate long and short dash line, and that a feeding path of the peeled-off separation material layer 3*c* is shown by the broken line, respectively.

<Feature of the present embodiment>

In the above described basic configuration and operation, a feature of the present embodiment lies in suppressing the coming-apart of the above described print-receiving tape 3A in the radial direction in the roll containing part 4. Hereinafter, details of the feature will be explained in order.

<Generation of Coming-Apart of Print-Receiving Tape>

As described above, the roll 3 is rotatably supported by the roll containing part 4. During the operation of print formation (printing) as described above, the roll 3 rotates by the pull-out of the print-receiving tape 3A by means of the above described platen roller 66 in a state of being supported in the roll containing part 4. When the above described printing operation stops, rotation of the roll 3 also stops by the halt of the pull-out by means of the above described platen roller 66. When execution and stop of the printing operation are repeated, rotation and stop of the roll 3 are also reiterated. As a result, in the roll 3, the above described print-receiving tape 3A wound in the rolled form may come apart in the radial direction. In a case where such coming-apart is generated, meandering of the print-receiving tape 3A occurs at the time of subsequent feeding, and there is a possibility of causing irregularity in print positions and deterioration of print quality.

Figure 7:
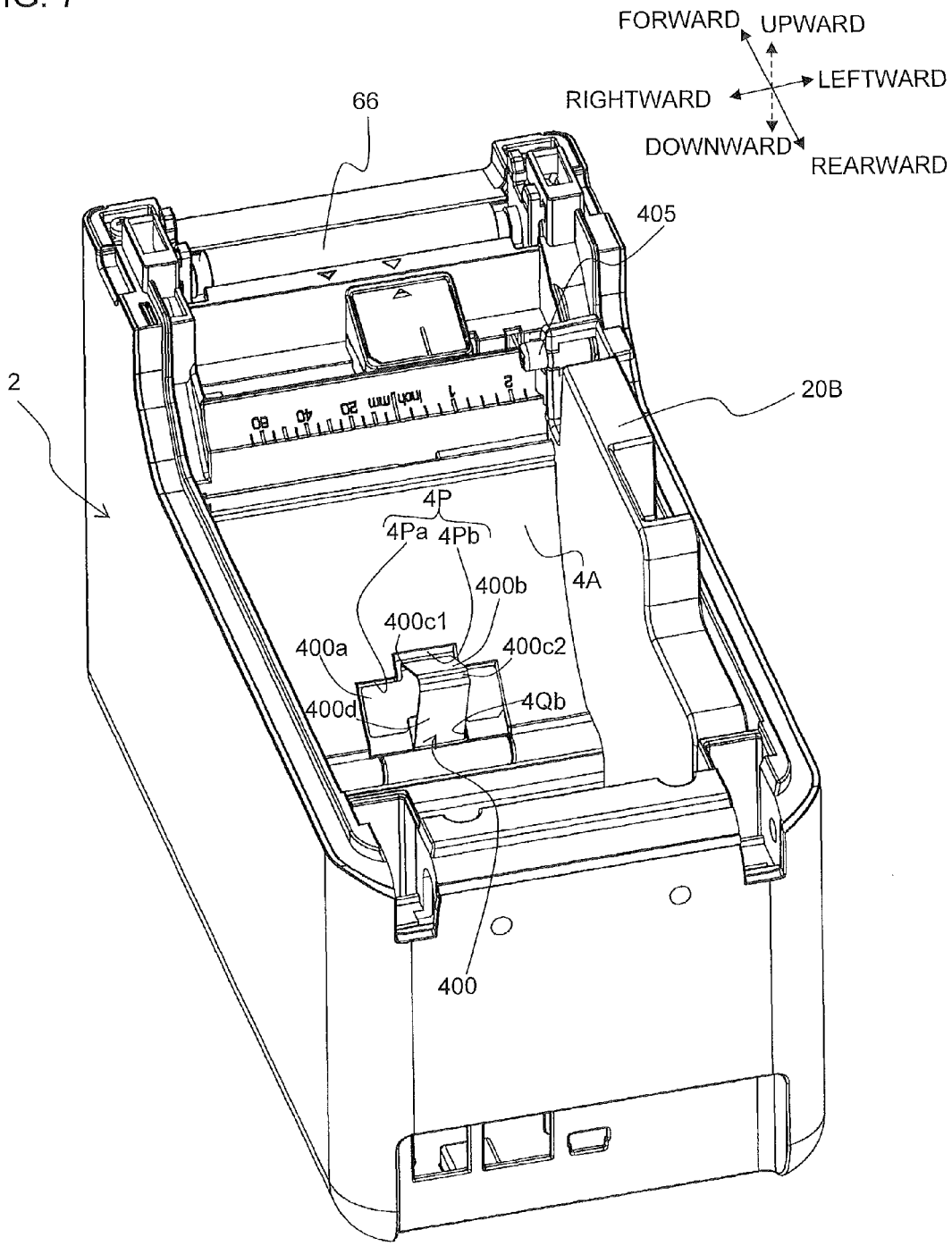
FIG. 7 is a perspective view of the label producing apparatus representing a front side portion of the roll containing part in which the upper cover unit is omitted, the roll containing part being in a state where a spring is attached.
Figure 8:
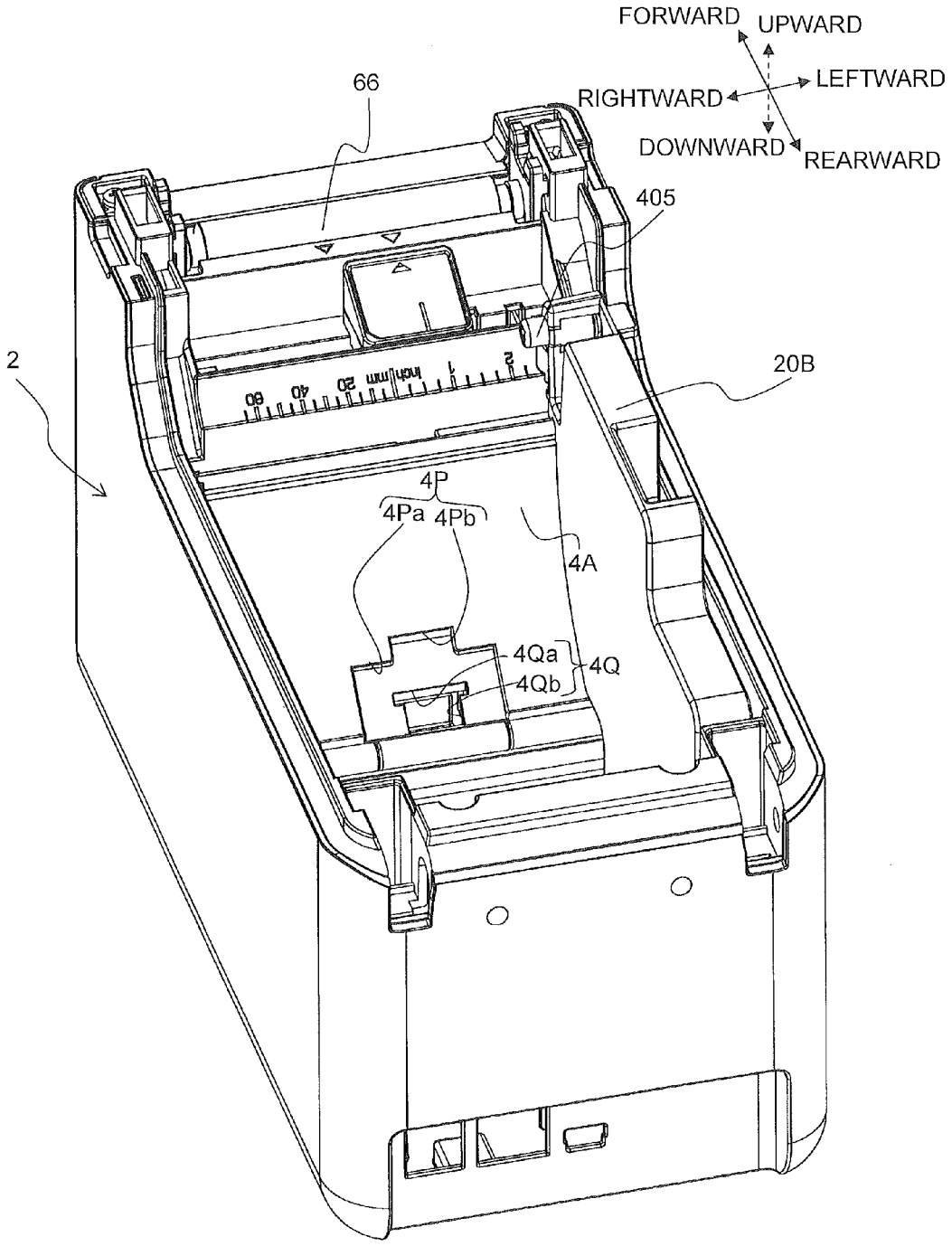
FIG. 8 is a perspective view of the label producing apparatus representing the front side portion of the roll containing part in which the upper cover unit is omitted, the roll containing part being in a state where the spring is removed.

Consequently, in the present embodiment, the spring 400 is disposed on the roll containing part 4 as shown in FIGS. 7 and 8. A detailed structure and function of the spring 400 will be explained using FIGS. 9, 10A and 10B, and the above described FIGS. 7 and 8.

Figure 9:
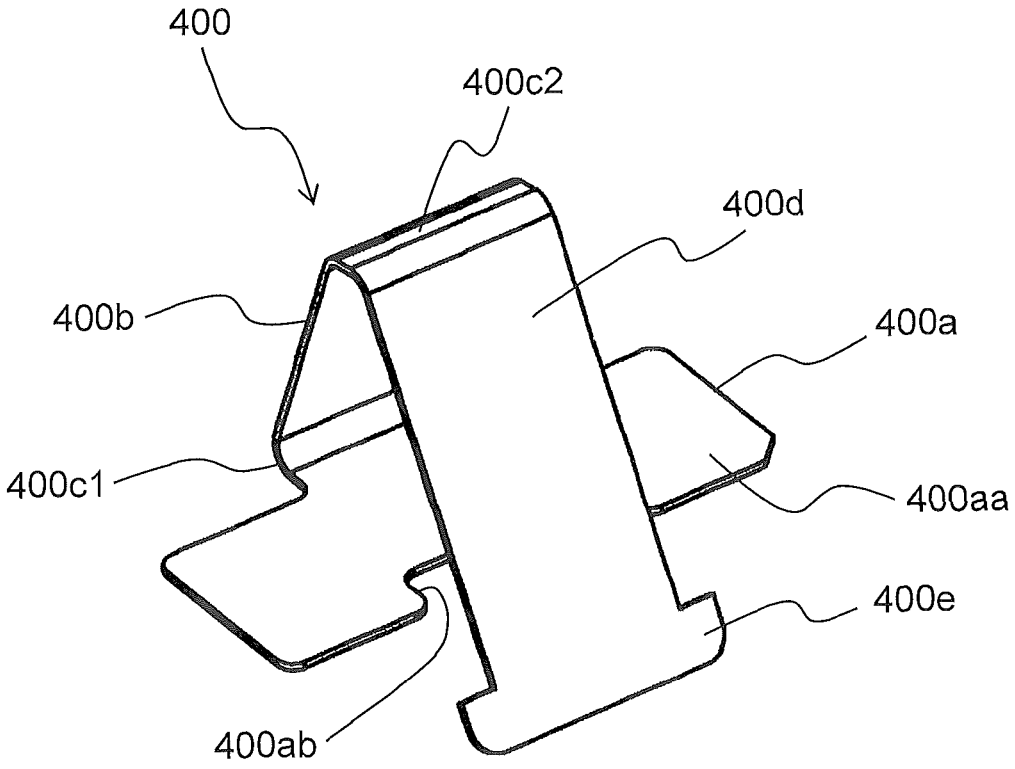
FIG. 9 is a perspective view representing a detailed structure of the spring.
Figure 10A:
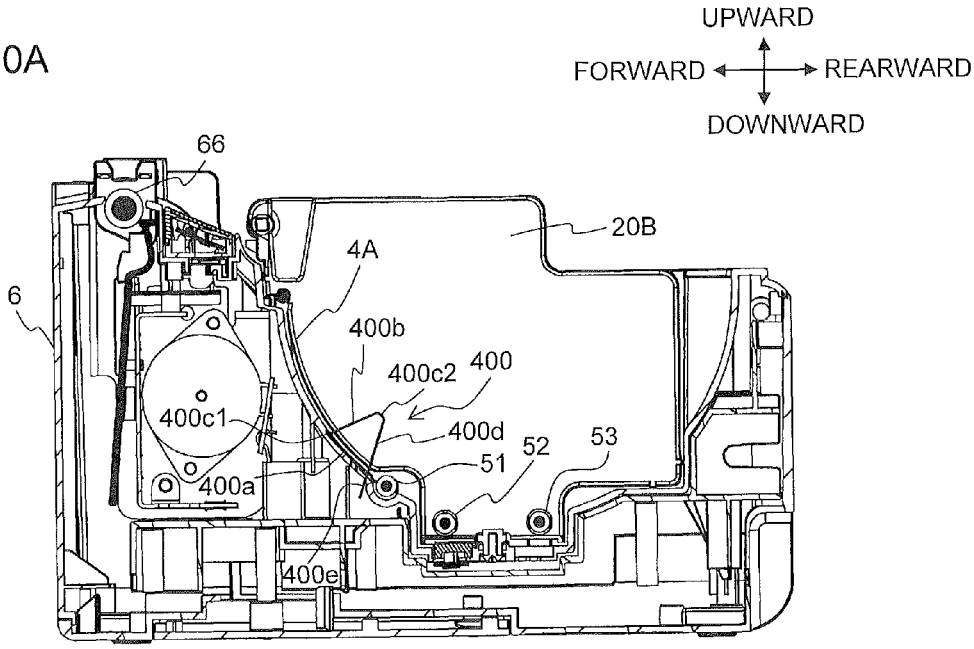
FIG. 10A is a main portion side sectional view of the label producing apparatus representing a state where the spring has been installed at the roll containing part.

The spring 400 is configured integrally with an elastic thin member, such as a film, in this example. This spring 400 includes, as shown in FIG. 9: a substantially plate-like base part 400*a*; a bent part 400*c*1 disposed on an end of the base part 400*a*; a rising part 400*b* disposed so as to rise from the base part 400*a* through the bent part 400*c*1; a bent part 400*c*2 disposed on an end of the rising part 400*b*; a folded part 400*d*; and a locking part 400*e*.

A concave part 400*ab* is disposed on one end side edge of the base part 400*a*. This concave part 400*ab* has a width direction size that is slightly larger than the above described folded part 400*d* and is smaller than the locking part 400*e*.

The folded part 400*d* is disposed folded so as to configure substantially an inverted V shape with the rising part 400*b* through the bent part 400*c*2. The locking part 400*e* is disposed on a tip of the folded part 400*d* so as to have a width direction size wider than the above described rising part 400*b*, bent parts 400*c*1 and 400*c*2, and folded part 400*d* that have a same width direction (corresponding to the above described right and left direction, the same hereinafter) size as one another. At this time, as shown in FIGS. 8 and 9, closer to a forward side than the above described first support roller 51 in the roll containing part 4, disposed are: a concave part 4P for containing the spring 400; and a spring insertion hole 4Q disposed so as to downwardly penetrate the concave part 4P.

The spring insertion hole 4Q includes: an insertion part 4Qa having a width direction size substantially equal (slightly larger) to (than) the above described locking part 400*e*; and a part to be locked 4Qb that is located at substantially a downward side of the insertion part 4Qa and has a width direction size smaller than the insertion part 4Qa and the above described locking part 400*e*. The concave part 4P includes: a base part roll containing part 4Pa having a width direction size substantially equal (slightly larger) to (than) the above described base part 400*a*; and a bent part roll containing part 4Pb having a width direction size substantially equal (slightly larger) to (than) the above described bent part 400*c*1.

Additionally, at the time of attachment of the spring 400 to the roll containing part 4, the above described locking part 400*e* is inserted in the above described insertion part 400Qa to be projected to a back side (i.e., a downward side) of the concave part 4P in a state where the above described folded part 400*d* is introduced to the above described concave part 400*ab* and subsequently, the locking part 400*e* is further slid downwardly. Since the part to be locked 4Qb has the width direction size smaller than the insertion part 4Qa and the above described locking part 400*e* as described above, by the above, the locking part 400*e* becomes a state of being locked at a back side (i.e., a downward side) of the part to be locked 4Qb. After that, while maintaining an introduced and contained state of the above described folded part 400*d* to the above described concave part 400*ab*, the base part 400*a* and the bent part 400*c*1 are introduced to the base part roll containing part 4Pa and the bent part roll containing part 4Pb, respectively, contained, and fixed. Due to this containment, a surface 400*aa* of the base part 400*a* becomes substantially a same surface (a state of neither projecting nor denting) as a circular arc-shaped bottom surface 4A of the roll containing part 4. In addition, the insertion part 4Qa is blocked by the above described containment of the base part 400*a* (refer to FIG. 7), and thereby achieved is slip-off stop of the locking part 400*e* in the state of being locked at the back side of the part to be locked 4Qb as described above.

Figure 10B:
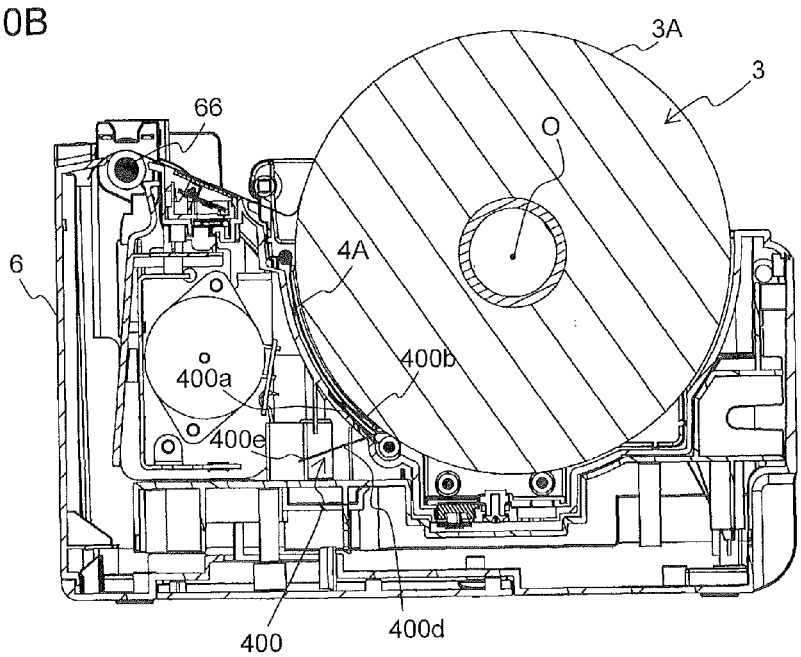
FIG. 10B is a main portion side sectional view of the label producing apparatus representing a behavior of roll pressing by the spring.

Due to the above described attachment state, the spring 400 elastically deforms in a state where the base part 400*a* is fixed to the base part roll containing part 4Pa (particularly, a bending angle of the bent part 400*c*1 changes), and thereby is displaced in a range from a state (refer to FIG. 10A) where the above described inverted V shape formed by the above described rising part 400*b*, bent part 400*c*2, and folded part 400*d* is completely appeared in the roll containing part 4 to a state where the folded part 400*d* gets out to a downward side of the roll containing part 4 (refer to FIG. 10B). Consequently, when the roll 3 is contained in the roll containing part 4, the spring 400, as shown in FIG. 10B, gets contact while always sliding with the outer peripheral surface of the roll 3 that is supported by the above described support rollers 51, 52, and 53 and is rotated. As a result, the spring 400 can elastically press the roll 3 from which the print-receiving tape 3A is fed out, inward in the radial direction of the roll 3. In this example, the spring 400 is arranged so as to be located closer to the forward side than the first support roller 51 in order to press an outer peripheral surface of a portion of the roll 3 closer to the forward side (left side in FIGS. 10A and 10B) than a roll center O (refer to FIG. 10B).

Figure 11:
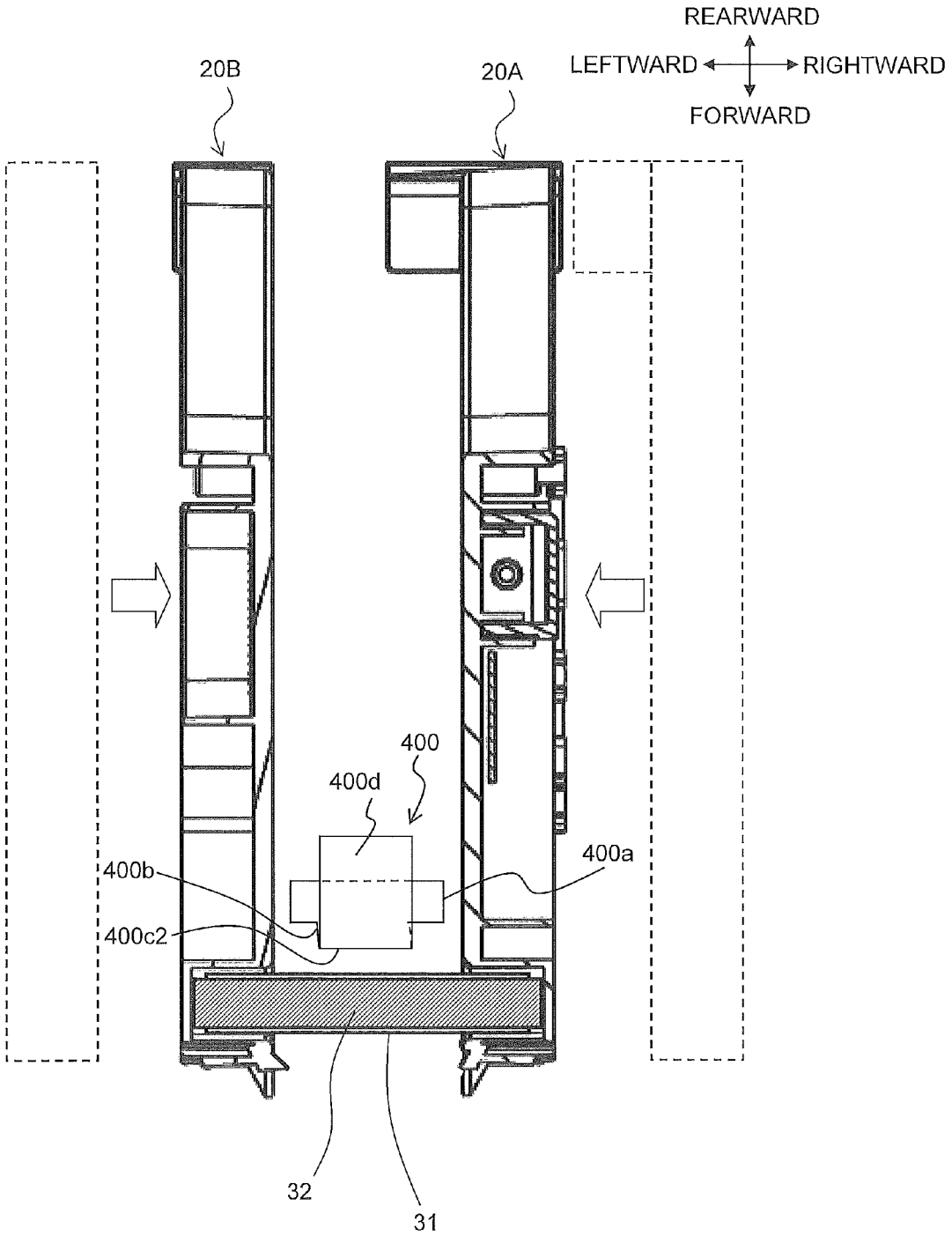
FIG. 11 is a plan view representing a closest state of a pair of guide members.

It is to be noted that at this time, as shown in FIG. 11, a roller width of the above described pressing roller 31 is set to be smaller than an interval between the above described guide members 20A and 20B in a state where the guide members 20A and 20B are interlocked to be approached to a minimum width (in a state of pinching the roll 3 with a minimum tape width). Additionally, the spring 400 is, as illustrated, arranged so as to be located between the guide members 20A and 20B when these guide members 20A and 20B are in a closest state.

<Advantages of the present embodiment>

As explained above, in the present embodiment, the spring 400 elastically presses the rotatably supported roll 3 inward in the radial direction (in the state where the print-receiving tape 3A has been fed out as described above). Consequently, the print-receiving tape 3A can be suppressed from coming apart in the radial direction as described above. As a result, the above described irregularity in print positions and deterioration of print quality can be suppressed.

In addition, particularly in the present embodiment, the roll 3 is rotatably carried on the support rollers 51, 52, and 53 in the roll containing part 4. As described above, in printing operation, the roll 3 rotates by the pull-out of the print-receiving tape 3A, and the support rollers 51, 52, and 53 rotate while being in contact with the outer peripheral surface of the rotating roll 3. In a case of such a support mode, since the roll 3 becomes a state of not being constrained at all in the radial direction other than at contact points with the support rollers 51, 52, and 53 in a lower portion, the above described coming-apart in the radial direction tends to occur. Accordingly, particularly effective is an effect of coming-apart suppression by the above described pressing in the radial direction by means of the spring 400.

In addition, in a configuration in which the roll 3 rotates in the state of being carried on the support rollers 51, 52, and 53 as described above, as already mentioned above, can be considered arrangement in which the print-receiving tape 3A is fed out from the upper side of the roll 3 as described above, and arrangement in which the print-receiving tape 3A is fed out from the lower side of the roll 3. Supposing a case where the print-receiving tape 3A is fed out from the lower side of the roll 3, carrying points of the above described support rollers 51, 52, and 53 are located near the feeding-out position (i.e., a self-weight of the roll 3 acts on the feeding-out position and a vicinity thereof), and thus a possibility is relatively low that the roll 3 comes loose from the support rollers 51, 52, and 53, etc. due to the above described pull-out. In contrast with this, when the print-receiving tape 3A is fed out from the upper side of the roll 3 as the above described embodiment, the self-weight as described above does not act on the feeding-out position and the vicinity thereof, and thus a possibility that a position of the roll 3 fluctuates because of the coming-loose of the roll 3 from the support rollers 51, 52, and 53, etc. due to the above described pull-out. Accordingly, particularly in the present embodiment, dealing with the case as described above, the spring 400 also has an effect of being able to suppress position fluctuation of the roll 3 by the pressing in the radial direction in addition to the coming-apart suppression action as described above.

In addition, when the print-receiving tape 3A is fed out from the upper side of the roll 3 in the above described manner, a force pulling the roll 3 in the pull-out direction (a force toward the forward side, i.e., the left side in FIG. 4) may act due to the above described pull-out. Particularly in the present embodiment, the spring 400 presses in the radial direction the portion of the side closer to the above described pull-out direction than the roll center O of the roll 3. Consequently, the roll 3 can be pressed in a direction opposite to the pull-out direction although moving in the pull-out direction (forward) due to the above described force. As a result, the above described position fluctuation of the roll 3 can be reliably suppressed.

Meanwhile, along with the feeding-out of the print-receiving tape 3A and consumption of the print-receiving tape 3A at the time of above described printing operation, an outer peripheral diameter of the roll 3 becomes gradually smaller from a maximum value to an intermediate value, and then to a minimum value. Here, supposing a configuration in which two support rollers having different positions in the peripheral direction with respect to the roll 3 are disposed in the roll containing part 4 instead of the above described three support rollers 51, 52, and 53. In this case, although the roll 3 can be stably supported by taking a large distance between these two support rollers even when the outer peripheral diameter of the roll 3 is large, there is a problem that the roll 3 drops off at the same time when the outer peripheral diameter of the roll 3 becomes smaller than a distance between the above described rollers, when the distance between the above described rollers is larger than the minimum value of the outer peripheral diameter of the roll 3. Meanwhile, although drop-off of the roll 3 can be suppressed by making smaller the distance between the two support rollers than the minimum value of the outer peripheral diameter of the roll 3, there is a problem in this case that the roll 3 cannot be stably supported when the outer peripheral diameter of the roll 3 is large.

Consequently, particularly in the present embodiment, three support rollers are disposed in the roll containing part 4 in order of the first support roller 51, the second support roller 52, and the third support roller 53 from the above described pull-out direction side toward the opposite side. The second support roller 52 and the third support roller 53 are arranged to have the positional relation of substantially horizontal to each other, and the first support roller 51 is arranged at the higher position than the second support roller 52 and the third support roller 53 (refer to FIG. 4 etc.). Consequently, the roll 3 is supported by the first support roller 51 and the third support roller 53 before the outer peripheral diameter of the roll 3 falls in a range from the maximum value to the intermediate value (a state shown in FIG. 4), the roll 3 is supported by the three of the first support roller 51, the second support roller 52, and the third support roller 53 when the outer peripheral diameter of the roll 3 becomes the intermediate value, and the roll 3 can be supported by the second support roller 52 and the third support roller 53 until the outer peripheral diameter of the roll 3 becomes the minimum value after becoming smaller than the intermediate value.

As described above, the setting configurations of the support rollers that support the roll 3 can be made to be different from each other according to the outer peripheral diameter of the roll 3. Since the distance between the rollers can be taken large by supporting the roll 3 by means of the first support roller 51 and the third support roller 53 in the range before the outer peripheral diameter of the roll 3 becomes the intermediate value from the maximum value, which is the comparatively large range, the roll 3 can be stably supported. In addition, since the roll 3 is supported by the second support roller 52 and the third support roller 53 in a range until the outer peripheral diameter of the roll 3 becomes the minimum value after becoming smaller than the intermediate value, which is the comparatively small range, drop-off of the roll 3 can be suppressed even though the outer peripheral diameter of the roll 3 becomes the minimum value by setting the distance between these rollers to be smaller than the minimum value of the outer peripheral diameter of the roll 3. Accordingly, in addition to the suppression effect of the position fluctuation of the roll 3 by means of the above described spring 400, the roll 3 can be stably supported also by these first to third support rollers 51, 52, and 53 (regardless of the outer peripheral diameter of the roll 3).

Furthermore, the following effects can be obtained when the outer peripheral diameter of the roll 3 is the intermediate value. Namely, in the print-receiving tape 3A being fed out from the roll 3 due to the above described pull-out at the time of feeding, generally, the larger the outer peripheral diameter of the roll 3 is, and the more the number of support rollers that support the roll 3 is, the more increases a load on the feeding-out of the tape due to inertia by the self-weight of the roll 3 and friction of the support rollers, etc. When the load becomes larger than a predetermined value, feeding-out of the print-receiving tape 3A from the roll 3 is not performed smoothly, and there is a possibility of causing meandering of the print-receiving tape 3A and deterioration of print quality.

Particularly in the present embodiment, when the outer peripheral diameter of the roll 3 becomes the intermediate value as described above, the roll 3 is supported by the three of the first support roller 51, the second support roller 52, and the third support roller 53. Namely, the roll outer peripheral diameter in the case where the number of support rollers that support the roll 3 is the maximum number of three can be set as the intermediate value, and the tape load can be significantly reduced as compared with the case of the maximum value. As a result, the load at the time of feeding out the print-receiving tape 3A from the roll 3 can be reduced. As a result, in addition to the effects of meandering suppression and improvement in print quality by the above described spring 400, similar effects of meandering suppression and improvement in print quality can be obtained also by these first to third support rollers 51, 52, and 53.

In addition, particularly in the present embodiment, the pair of guide members 20A and 20B that gets contact with the both-side end surfaces of the print-receiving tape 3A fed out from the roll 3 and guides the print-receiving tape 3A is disposed in an approachable manner in the width direction of the roll 3. Consequently, even when plural types of rolls 3 having various tape widths are used, each tape can be reliably guided from both sides in a width direction, and smooth tape feeding can be performed. In so doing, the spring 400 is, as shown in FIG. 11, arranged so as to be located between the pair of guide members 20A and 20B in the state where the pair of guide members 20A and 20B is the closest to each other. Consequently, the spring 400 can be arranged at the roll containing part 4 without impeding a function of guiding the above described print-receiving tape 3A by making the above described pair of guide members 20A and 20B approach and separate to/from each other.

It is to be noted that although in the above, has been explained as an example the configuration in which the roll 3 is rotated and supported in the roll containing part 4 in a mode where the support rollers 51, 52, and 53 are in contact with the lower portion, the present disclosure is not limited to this. Namely, the present disclosure can be applied to a configuration in which the roll is, for example, wound around a substantially cylindrical winding core, and in which the winding core is rotatably supported by the housing side through the tape holder. In this case, the winding core and the tape holder are included in the roll supporting part, and an effect similar to the above can be obtained.

In addition, although in the above, has been explained as an example the case where the print-receiving layer 3*a* and the adhesive layer 3*b* in which printing has been finished are cut by the cutting blade 8 to produce print labels, the present disclosure is not limited to this. Namely, in a case where the label mounts L (so-called die-cut labels) previously separated as a desired size corresponding to a label are continuously arranged on the tape fed out from the roll 3, only the label mount (on which corresponding print has been made) may be peeled from the tape to produce a print label after the tape is discharged from the discharging exit 6A without cutting the tape by the cutting blade 8, and the present disclosure can be applied also to the tape with the label mounts as described above.

In addition, although in the above, a system is employed in which printing is performed on the print-receiving layer 3*a* included in the print-receiving tape 3A, the present disclosure is not limited to this, and the present disclosure may be applied to a system in which printing is performed on cover films different from the print-receiving layer 3*a*, and the cover films are pasted.

In addition, a roll is not limited to a roll that can be attached and detached to/from a label producing apparatus 1 main body side like the above described roll 3, either, and it can be also considered that a roll is disposed as a so-called installation type or integrated type that cannot be attached and detached to/from the apparatus main body side. A similar effect is obtained also in this case.

In addition, although in the above, has been explained as an example of the printer the print label producing apparatus that performs desired printing on the print-receiving tape 3A and produces print labels, the present disclosure is not limited to this. Namely, as one example of the printer, for example, the present disclosure may be applied to a printer that forms images and prints characters on usual print-receiving papers of sizes, such as an A4, A3, a B4, and B5 sizes, and a portable printer driven by a battery power source. A similar effect is obtained also in this case.

In addition, techniques by the above described embodiment and each modified example may be appropriately combined and utilized in addition to the examples already described above.

What is claimed is:

1. A printer comprising:

a roll supporting part configured to rotatably support a print-receiving tape roll, wherein the print-receiving tape roll includes a print-receiving tape in a rolled shape;

a feed roller configured to pull out and feed the print-receiving tape included in the print-receiving tape roll supported by the roll supporting part;

a printing head configured to print on the print-receiving tape that is pulled out and fed from the print-receiving tape roll by the feed roller; and an urging device configured to slide to and contact an outer peripheral surface of the print-receiving tape in the rolled shape and to elastically press the print-receiving tape roll supported by the roll supporting part while the print-receiving tape is pulled out and fed from the print-receiving tape roll, wherein the roll supporting part is a roll containing part configured to rotatably contain the print-receiving tape roll, wherein the printer further comprises at least one support roller in the roll containing part, the at least one support roller being configured to, when the print-receiving tape is pulled out and fed from the print-receiving tape roll by the feed roller, rotate by contacting the outer peripheral surface of the print-receiving tape in the rolled shape and rotatably support the print-receiving tape roll, wherein the roll containing part contains the print-receiving tape roll such that the print-receiving tape is pulled out and fed from an upper side of the print-receiving tape roll, wherein the print-receiving tape is pulled out and fed from the print-receiving tape roll at a feeding out position, wherein the feeding out position is located nearer to a position where the urging device contacts the outer peripheral surface of the print-receiving tape in the rolled shape than to a center of the print-receiving tape roll, wherein the at least one support roller comprises three rollers, wherein as the print-receiving tape is pulled out and fed from the print-receiving tape roll, the outer peripheral surface of the print-receiving tape in the rolled shape has a diameter in a range from a maximum diameter to a minimum diameter, wherein at least two rollers of the three rollers are arranged such that the at least two rollers continuously contact the outer peripheral surface of the print-receiving tape in the rolled shape when the diameter is in the range from the maximum diameter to the minimum diameter, wherein the three rollers are arranged in an order of a first roller, a second roller, and a third roller from the feeding out position in a direction extending from the feeding out position toward an opposite side of the print-receiving tape roll from the feeding out position, wherein the second roller and the third roller are substantially horizontal to each other, and the first roller is located above the second roller and the third roller, and wherein the feeding out position is located nearer to the position where the urging device contacts the outer peripheral surface of the print-receiving tape in the rolled shape than to the first roller.

2. The printer according to claim 1, further comprising a pair of guide members disposed in the roll containing part such that the guide members are mutually approachable along a width direction of the print-receiving tape roll, and such that the guide members are configured to guide the print-receiving tape that is pulled out and fed from the print-receiving tape roll by contacting respective end surfaces, in the width direction, of the print-receiving tape roll, wherein the urging device is disposed in the roll containing part such that the urging device is located between the guide members when the guide members are in a mutually closest state.

3. A printer comprising:

a roll supporting part configured to rotatably support a print-receiving tape roll comprising a print-receiving tape therein;

a feed roller configured to pull out and feed the print-receiving tape included in the print-receiving tape roll supported by the roll supporting part;

a printing head configured to print on the print-receiving tape that is pulled out and fed from the print receiving tape roll by the feed roller; and an urging device configured to elastically press a surface of rolled print-receiving tape disposed in an outer peripheral part of the print-receiving tape roll supported by the roll supporting part while the print-receiving tape is pulled out and fed from the print-receiving tape roll, wherein the roll supporting part is a roll containing part configured to rotatably contain the print-receiving tape roll, wherein the printer further comprises at least one support roller in the roll containing part, the at least one support roller being configured to, when the print-receiving tape is pulled out and fed from the print-receiving tape roll by the feed roller, rotate by contacting the surface of the rolled print-receiving tape disposed in the outer peripheral part of the print-receiving tape roll supported by the roll supporting part, wherein the roll containing part contains the print-receiving tape roll such that the print-receiving tape is pulled out and fed from an upper side of the print-receiving tape roll, wherein the print-receiving tape is pulled out and fed from the print-receiving tape roll at a feeding out position, wherein the feeding out position is located nearer to a position where the urging device presses the surface of the rolled print-receiving tape than to a center of the print-receiving tape roll, and wherein:

the at least one support roller comprises three rollers, as the print-receiving tape is pulled out and fed from the print-receiving tape roll, the surface of the rolled print-receiving tape has a diameter in a range from a maximum diameter to a minimum diameter, at least two rollers of the three rollers are arranged such that the at least two rollers continuously contact the surface of the rolled print-receiving tape when the diameter is in the range from the maximum diameter to the minimum diameter, the three rollers are arranged in an order of a first roller, a second roller, and a third roller from the feeding out position in a direction extending from the feeding out position toward an opposite side of the print-receiving tape roll from the feeding out position, the second roller and the third roller are substantially horizontal to each other, and the first roller is located above the second roller and the third roller, and the feeding out position is located nearer to the position where the urging device presses the surface of the rolled print-receiving tape than to the first roller.

4. The printer according to claim 3, further comprising a pair of guide members disposed in the roll containing part such that the guide members are mutually approachable along a width direction of the print-receiving tape roll, and such that the guide members are configured to guide the print-receiving tape that is pulled out and fed from the print-receiving tape roll by contacting respective end surfaces, in the width direction, of the print-receiving tape roll, wherein the urging device is disposed in the roll containing part such that the urging device is located between the guide members when the guide members are in a mutually closest state.

5. A printer comprising:

a roll supporting part configured to rotatably support a print-receiving tape roll, wherein the print-receiving tape roll includes a print-receiving tape in a rolled shape;

a feed roller configured to pull out and feed the print-receiving tape included in the print-receiving tape roll supported by the roll supporting part;

a printing head configured to print on the print-receiving tape that is pulled out and fed from the print-receiving tape roll by the feed roller; and an urging device configured to slide to and contact an outer peripheral surface of the print-receiving tape in the rolled shape and to elastically press the print-receiving tape roll supported by the roll supporting part while the print-receiving tape is pulled out and fed from the print-receiving tape roll, wherein the roll supporting part is a roll containing part configured to rotatably contain the print-receiving tape roll, wherein the printer further comprises at least one support roller in the roll containing part, the at least one support roller being configured to, when the print-receiving tape is pulled out and fed from the print-receiving tape roll by the feed roller, rotate by contacting the outer peripheral surface of the print-receiving tape in the rolled shape and rotatably support the print-receiving tape roll, and wherein:

said urging device includes:

a substantially plate-like base part;

a first bent part disposed on an end of the base part;

a rising part disposed so as to rise from the base part through the first bent part;

a second bent part disposed on an end of the rising part;

a folded part; and a locking part, and said urging device is displaced in a range from a state where an inverted V shape formed by said rising part, the second bent part, and said folded part is completely appeared in said roll containing part to a state where said folded part gets out to a downward side of said roll containing part.

* * * * *